United States Patent [19]

Huang

[11] Patent Number: 4,973,972

[45] Date of Patent: Nov. 27, 1990

[54] STRIPLINE FEED FOR A MICROSTRIP ARRAY OF PATCH ELEMENTS WITH TEARDROP SHAPED PROBES

[75] Inventor: John Huang, Arcadia, Calif.

[73] Assignee: The United States of America as represented by the Administrator of the National Aeronautics and Space Adminstration, Washington, D.C.

[21] Appl. No.: 404,293

[22] Filed: Sep. 7, 1989

[51] Int. Cl.[5] ..... H01Q 1/38

[52] U.S. Cl. ..... 343/700 MS; 343/829; 333/26

[58] Field of Search ..... 343/700 MS, 829; 333/26, 33, 34, 124, 125, 127, 128, 136

[56] References Cited

U.S. PATENT DOCUMENTS

| | | | |
|---|---|---|---|
| 2,658,145 | 11/1953 | Dorne et al. | 250/33 |
| 4,283,694 | 8/1981 | Pauker | 333/34 |
| 4,320,401 | 3/1982 | Schiavone | 343/700 MS |
| 4,414,550 | 11/1983 | Tresselt | 343/700 |
| 4,477,813 | 10/1984 | Weiss | 343/700 MS |
| 4,543,579 | 9/1985 | Teshirogi | 343/365 |
| 4,660,048 | 4/1987 | Doyle | 343/700 |
| 4,719,470 | 1/1988 | Munson | 343/700 MS |

FOREIGN PATENT DOCUMENTS

| | | | |
|---|---|---|---|
| 58-95407 | 6/1983 | Japan | 343/700 MS |

OTHER PUBLICATIONS

F. Naderi et al., "NASA's Mobile Satellite Communications Program; Ground and Space Segment Technologies," 35th International Aeronautics Federation Congress, Laussane, Switzerland, Oct. 10, 1984.

V. Jamnejad, "Multibeam Feed System Design Considerations for Single Aperture Large Space Antennas," NASA Conference on Large Space Antenna Technology, Dec., 1984.

K. Woo, "Multiple Beam Antenna Feed Development," 1986 AP-S International Symposium Digest, IEEE Antennas and Propagat. Soc. Publication, pp. 409–412, Jun. 1986.

J. Huang, "Circularly Polarized Conical Patterns from Circular Microstrip Antennas," IEEE Trans. Antennas Propagat., vol. AP-32, No. 9, pp. 991–994, Sep. 1984.

J. Huang, "A Technique for an Array to Generate Circular Polarization with Linearly Polarized Elements," IEEE Trans. Antennas Propagat., vol. AP-34, No. 9, pp. 1113–1124, Sep. 1986.

W. Richards et al., "An Improved Theory for Microstrip Antennas and Applications," IEEE Trans. Antennas Propagat., vol. AP-29, pp. 38–46, Jan., 1981.

P. S. Hall et al., "Gain of Circularly Polarized Arrays Composed of Linearly Polarized Elements," Electron Lett., 1989, 25, pp. 124–125.

*Primary Examiner*—Rolf Hille
*Assistant Examiner*—Hoanganh Le
*Attorney, Agent, or Firm*—Thomas H. Jones; John R. Manning

[57] ABSTRACT

A circularly polarized microstrip array antenna utilizing a honeycomb substrate made of dielectric material to support on one side the microstrip patch elements in an array, and on the other side a stripline circuit for feeding the patch elements in subarray groups of four with angular orientation and phase for producing circularly polarized radiation, preferably at a 0°, 90°, 180° and 270° relationship. The probe used for coupling each feed point in the stripline circuit to a microstrip patch element is teardrop shaped in order to introduce capacitance between the coupling probe and the metal sheet of the stripline circuit that serves as an antenna ground plane. The capacitance thus introduced tunes out inductance of the probe. The shape of the teardrop probe is not critical. The probe capacitance required is controlled by the maximum diameter for the teardrop shaped probe, which can be empirically determined for the operating frequency. An aluminum baffle around each subarray blocks out surface waves between subarrays.

6 Claims, 7 Drawing Sheets

STRIPLINE FEED FOR A MICROSTRIP ARRAY OF PATCH ELEMENTS WITH TEARDROP SHAPED PROBES

ORIGIN OF THE INVENTION

The invention described herein was made in the performance of work under a NASA contract, and is subject to the provisions of Public Law No. 96-517 (35 USC 202) in which the Contractor has elected not to retain title.

TECHNICAL FIELD

This invention relates to a stripline feed for a microstrip array of patch elements using a single probe for connection between a stripline feed circuit and each element through a honeycomb substrate, and more particularly to the use of probes that are teardrop shaped to provide capacitance that cancels inductance to the probe, thereby to provide input impedance matching and thus achieve wide bandwidth coupling into the array of patch elements.

BACKGROUND ART

Very large, multiple-beam satellite antennas in the 20 to 55 m range in size have been planned for mobile communication outlined in a paper presented at the 35th Annual International Astronautics Federation Congress, Laussane, Switzerland, Oct. 10, 1984, titled "NASA's Mobile Satellite Communications Program; Ground and Space Segment Technologies." To cover the continental United States, from 40 to 90 contiguous beams are to be generated from overlapping cluster feed arrays with diameters of up to six meters. In order to be compatible with the launching vehicle for the satellite, the antenna arrays should have the capability of being folded and stowed in the launch vehicle. Consequently, the array should be low in profile and light in weight. The problem is then to provide an array of elements for a satellite antenna with sufficient broadband performance to meet the requirements of the land mobile communications system and at the same time meet the low profile and lightweight requirements of the satellite.

A paper, titled "A Technique for an Array to Generate Circular Polarization with Linearly Polarized Elements" by the present inventor published in IEEE Transactions on Antenna and Propagation, Vol. AP-34, No. 9, Sep. 1986, pp. 1113–1124, presents theoretical and experimental results that demonstrate an array which generates circular polarization with wide axial ratio bandwidth (10 percent) can be constructed with single feed linearly polarized elements. The following paragraphs are essentially excerpted from that paper.

The reason that a circularly polarized array can be constructed by linearly polarized elements is primarily attributed to a four-element subarray with unique angular and phase arrangements. This basic subarray has its elements arranged in a 2×2 square or rectangular grid configuration with element angular orientation and feed phase arranged in either a 0°, 90°, 0°, 90° or a 0°, 90°, 180°, 270° relationship. The purpose of different angular orientations of the patches is to generate two orthogonally polarized fields, while different feed phases are used to provide the required phase delays for the desired circular polarization. It is well known that circular polarization can be achieved in the broadside direction of an array composed of two linearly polarized elements with angle and phase arranged in a 0°, 90° relationship as shown in FIG. 1*b* for the bottom two patches. The same relationship is used for the other two elements, but reversed.

When only two linearly polarized (rectangular) patch elements are used and they are oriented at 90° with respect to each other, the circular polarization becomes very poor at angles greater than 5° off the broadside direction. This is caused by the spatial phase delay formed between the two orthogonally polarized elements. This spatial phase delay, which disturbs the required 90° phase differential, contributes to the poor circular polarization quality at angles off broadside. With the 2×2 subarray, shown in FIG. 1*a* or 1*b*, this spatial phase delay no longer exists. This is because, within the two principle planes, the spatial phase delay in one row or column is opposite to that of the other row or column and, consequently, they cancel each other.

With such a system, not only is the feed complexity reduced, but also the bandwidth performance is improved. The reason for reduced feed complexity is because this technique only requires a single feed for each element while four feeds might be needed for each element in a conventional array with wide axial ratio bandwidth requirement. Due to the orthogonal orientation of neighboring elements, the mutual coupling effect is found to be significantly reduced from that of a conventional array. Finally, this uniquely arranged array can scan its main beam in the principle planes from its broadside direction to relatively wide angles without serious degradation of its circular polarization quality.

The concept presented in that paper is good for many different types of antenna elements, such as microstrip patches, dipoles, open-ended waveguides, horns, etc. However, this invention places special emphasis on the microstrip element as a result of a need for a large antenna array with a low profile and light weight. The present invention uses microstrip patches and the phase relationship between elements selected are as shown in FIG. 1*b*.

For a microstrip array antenna with a relatively thick substrate, there is a distinct advantage if the array antenna has its 2×2 subarrays arranged in the 0°, 90°, 180°, 270° fashion for both its element orientations and feed phases as shown in FIG. 1*b*. In this fashion, the axial ratio bandwidth of the array can be increased substantially. This is because most of the radiation impurity (due to higher order modes of the thick substrate) from the 0° element cancels that from the 180° element and likewise for the 90° and 270° elements.

One important advantage found to be associated with the 2×2 array discussed here is that the mutual coupling of the array is significantly less than that of a conventionally arranged array. This is due to the fact that all the adjacent elements of this uniquely arranged array are orthogonally oriented and hence cause very little coupling between immediate neighboring elements.

The monolithic array with microstrip elements is playing an important role in the advance of phased array technology. It is more feasible to build a linearly rather than circularly polarized element with a quarter-wave long microstrip patch, and then provide a feed line circuit with phase shifters as required to realize 0°, 9°, 180°, 270° phase relationship for circular polarization from a single feed point to the 2×2 subarray. With such a uniquely arranged subarray, it is possible to construct a circularly polarized monolithic phased array with enough room left for active devices to be etched on the same substrate.

The following describes the development of a new array which has a relatively broadband performance sufficient to cover the bandwidth requirements of the satellite antenna of the land mobile communication system. To cover both downlink frequencies (1545 to 1550 MHz) and uplink frequencies 1646 MHz to 1660 MHz) with a maximum of 1.5:1 input voltage standing wave ratio (VSWR), the microstrip antenna patch with a half-inch thick honeycomb-supported substrate has been selected as an example for the linearly polarized radiating element in arrays for circularly polarized radiation. Since a half-inch (0.07 wavelength) substrate is relatively thick for microstrip radiators. four feed probes would be required per single element of an array to suppress the undesired higher order modes and thus to generate acceptable circular polarization across the total bandwidth. For a large array, such a four-probe feed system for each microstrip patch would increase the complexity of an already complex feeding and beam-forming network, and would make it heavier and more prone to RF losses. For that reason, a 2×2 microstrip patch array is used and fed as a subarray from a single coaxial connector to function as a circularly polarized antenna element.

STATEMENT OF THE INVENTION

A circularly polarized microstrip array antenna is comprised of a cluster of seven subarrays, one subarray at the center and six subarrays spaced around the center subarray. Each of the seven subarrays of a cluster is comprised of a square grid array of four linearly polarized rectangular microstrip patch elements with a feed phase and angular orientation for circular orientation. The feed into the grid at the center utilizes a Wilkinson stripline power divider to divert energy into both a left and right branch with a longer line length in one branch for 180° phase shift relative to the other branch. Two additional Wilkinson stripline power dividers then divide the energy at each branch into two paths with longer line lengths in one path to introduce a 90° phase difference in the energy at the two ends of the branch so that at the four corners of the grid there is a phase difference in the energy delivered to the four microstrip patch elements having a physical orientation relative to each other of 0°, 90°, 180° and 270° . The result is a circularly polarized beam from each subarray of four linearly polarized patch elements, each element being fed through the stripline circuit of power dividers and delay lines.

For rigidity and light weight, a suitably thick honeycomb construction is used for the substrate that supports the microstrip patches in each subarray of a cluster (or overlapping clusters) on one side and the stripline feed circuits subarrays on the other side. Each subarray of four microstrip patches is surrounded by an aluminum baffle .about one inch tall to prevent mutual coupling between subarrays. In each subarray, the microstrip patch on one side of the honeycomb substrate is fed from the stripline circuit on the other side through a probe that is teardrop shaped to effectively tune out inductance around the feed probe and provide 7.5% bandwidth for 1.5:1 VSWR impedance match by introducing capacitance to cancel the undesired probe inductance. The exact teardrop shape is not critical; only the maximum diameter is important, and that may be determined empirically for the operating frequency.

DETAILED DESCRIPTION OF THE INVENTION

Figure 1B:
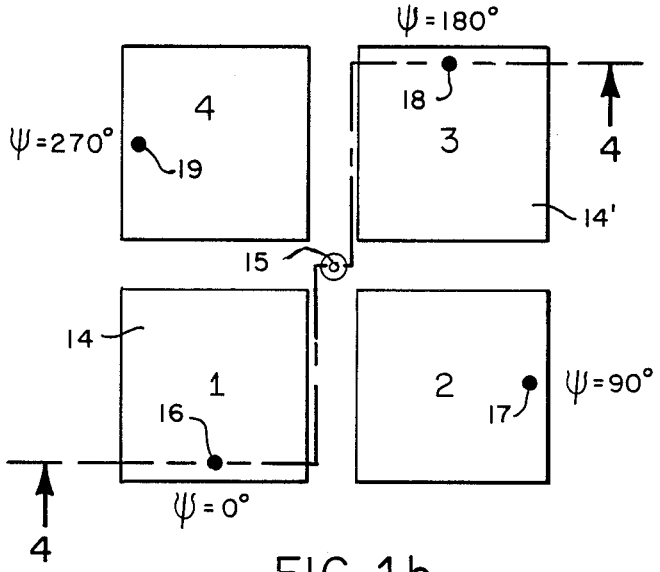
FIG. 1b (Prior Art)
Figure 2:
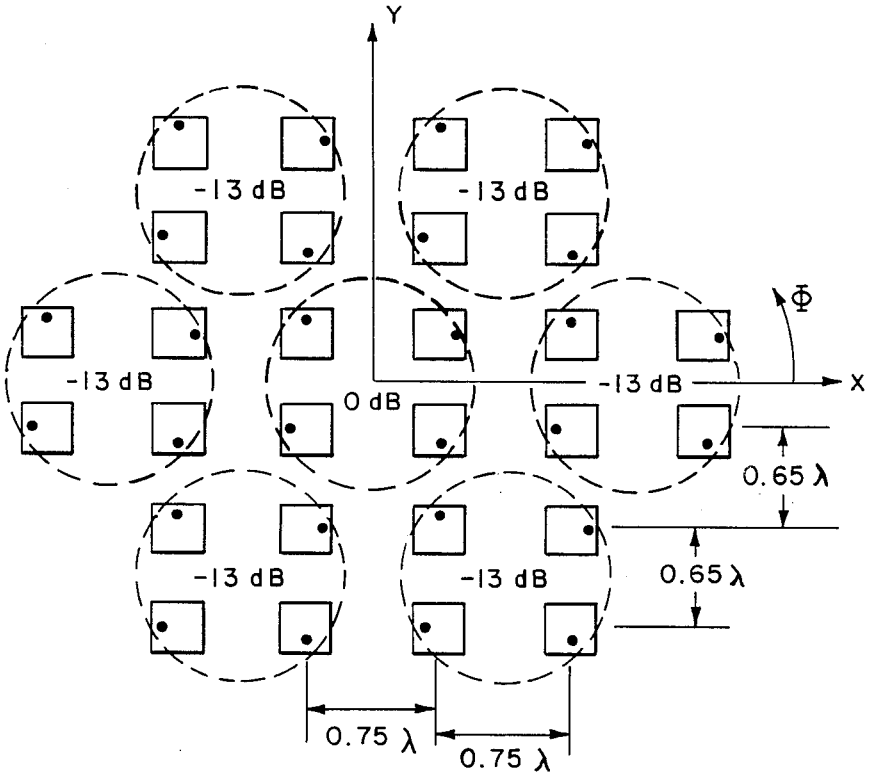
FIG. 2 (Prior Art)
FIG. 2 illustrates a single cluster of seven subarrays, where the orientation and phase arrangement is the same for each subarray as shown in FIG. 1.

An example of the present invention utilizing the subarray of FIG. 1*b* and a cluster of seven subarrays as shown in FIG. 2 will be described for use in a satellite to provide L-band communication via a satellite which receives the uplink communication from a land mobile unit and processes it for retransmission to a land mobile unit at a different frequency using the same array antenna for both the uplink and the downlink.

Figure 3:
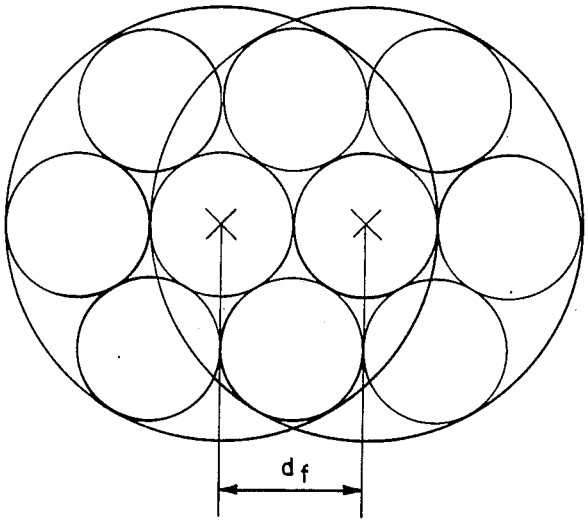
FIG. 3 (Prior Art)
FIG. 3 illustrates two overlapping clusters of seven subarrays with a separation distance, $d_f$, between the two cluster feeds.

In order to provide contiguous beams covering the United States, overlapping cluster arrays are to be employed. An earlier experiment has demonstrated the feasibility of generating beams with 3 dB crossover levels and very low sidelobes by using this overlapping cluster concept. In that experiment, relatively narrowband 7-subarray clusters of microstrip patches were used as shown in FIG. 3. For this invention, to be described with reference to FIGS. 4*a* through 6, the microstrip antenna was made with a half-inch thick honeycomb panel 10 to support the overlapping clusters. A cross section of the honeycomb panel is illustrated schematically in FIG. 4*a* where hexagonal cavities extend perpendicular to a dielectric substrate 11 sandwiched between a pair of metal sheets 12*a* and 12*b* of a stripline circuit which serves as an antenna ground plane. This cross section is taken on a line 4—4 of FIG. 1*b*.

A dielectric sheet 13 closes the hexagonal cavities on the side opposite the dielectric substrate 11, and microstrip patches 14 of the array antenna are deposited on the dielectric sheet 13. For each 2×2 subarray, there is embedded in the dielectric sheet 11 a metal pattern shown in FIG. 5 (with the patch elements indicated by dotted lines) to form a stripline Wilkinson 4-way power dividing circuit electrically insulated between the metal sheets 12*a* and 12*b*.

Figure 1A:
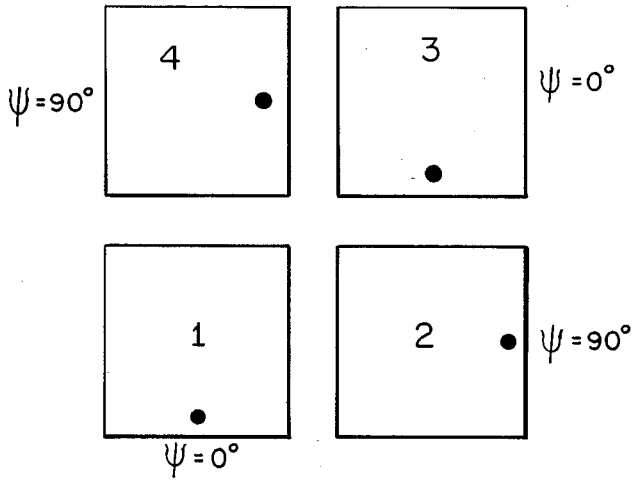
FIG. 1a (Prior Art)
FIGS. 1*a* and 1*b* illustrate a grid array, referred to herein as a subarray, of four identical linearly polarized patch elements with specific 0°, 90°, 0°, 90°, and 0°, 90°, 180°, 270° angular orientation and feed phase, respectively, for radiating a circularly polarized beam.
Figure 4A:
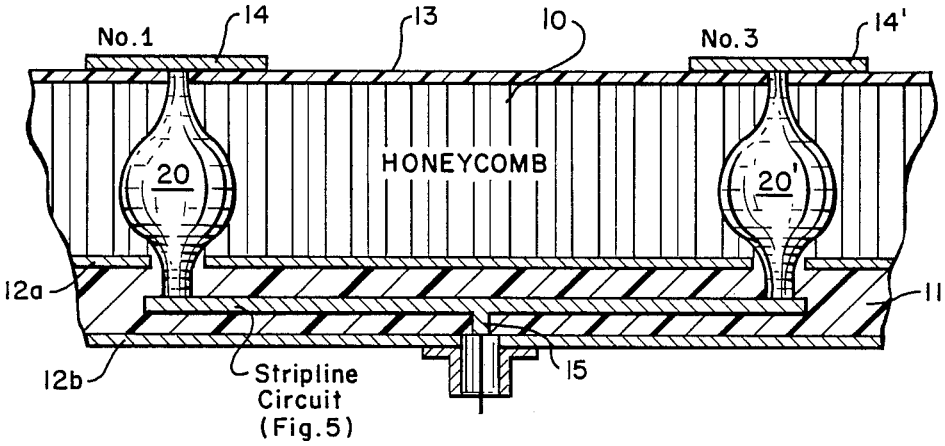
FIG. 4*a* illustrates in a cross section taken on a line 4—4 of FIG. 1*b* with a separate teardrop probe from the stripline circuit shown in FIG. 5 to each one of the microstrip patch elements shown in FIG. 1*b* of a subarray.
Figure 5:
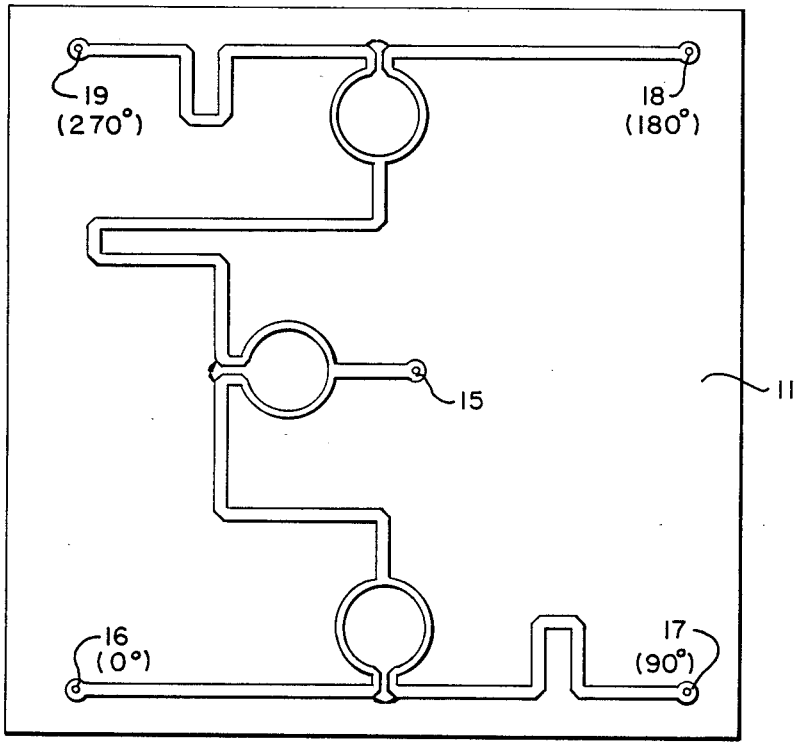
FIG. 5 illustrates a four-way power divider stripline circuit with line lengths selected to achieve 0°, 90°, 180° and 270° feed phases from a single feed point in the center.

Referring to FIG. 5, the Wilkinson 4-way power dividing circuit uses conductive lines from a coaxial connector feed point 15 of different lengths to achieve 0°, 90°, 80° and 270° phases to feed points 16, 17, 18 and 19 for the four patch elements 1, 2, 3 and 4 of the 2×2 subarray of FIG. 1. The conductive line from the feedpoint 15 is first divided through two halves of a circle to feed two branches, upper and lower as viewed in FIG. 5, and the conductive line of each branch is further divided into two (left and right) halves. The line length to the upper branch is longer than the one to the lower branch by an amount sufficient to introduce a 180° phase delay in the conduction to the right. In the upper and lower branches, a further 90° phase delay is similarly introduced in one half of the conductive line beyond the Wilkinson power divider in the branch, i.e., beyond semicircular conductive paths into the right and left halves of the upper and lower branches. In that way the necessary quadrature phase relationships is obtained from a single feed at point 15 between the successive pairs of the microstrip patches 1, 2, 3 and 4 of FIG. 1*b* for the desired circular polarization. It is of course possible to accomplish the same circular polarization in a similar way using the known Wilkinson power dividers and appropriate conductive line lengths with the phase relationship between successive pairs of the patches 1, 2, 3 and 4 shown in FIG. 1*a*, namely 0°, 90°, 0° and 90°, but the phase relationship of FIG. 1*b* is preferred for the reason noted above. Thus, the stripline feed circuit uses different line lengths to generate the required phases and uses Wilkinson power dividers to isolate any returned power due to mismatch and mutual coupling, in a manner well known to those skilled in the art. The measured insertion loss of this stripline power divider circuit is 0.7 dB maximum across the total bandwidth. Note that because of the section taken along the line 4—4 in FIG. 1*b* for FIG. 4*a* , the microstrip patches 14 and 14' are the ones numbered 1 and 3 in FIG. 1*b*.

Since a half-inch (0.07 wavelength) substrate for an L-band array antenna is relatively thick for microstrip radiators, four feed probes are required per single patch element to suppress the undesired higher order modes and thus to generate acceptable circular polarization across the total bandwidth. See John Huang, "Circularly Conical Patterns from Circular Microstrip Antenna," IEEE Trans. Antennas Propagation, Vol. AP-32, No. 9, pp. 991–998, Sep. 1984. For a large array, such a single-patch four-probe feed system would increase the complexity of an already complex feeding and beam-forming network and would make it heavier and more prone to RF losses. Consequently, it is preferred to obtain circularly polarized radiation from single-probe fed linearly polarized patch elements. The circularly polarized radiation is achieved by the prior-art 2×2 subarray of FIG. 1*b* with specific orientation and phase arrangement for the four patch elements. With such a system, not only is the feed complexity reduced, but also the bandwidth performance is improved.

Figure 4B:
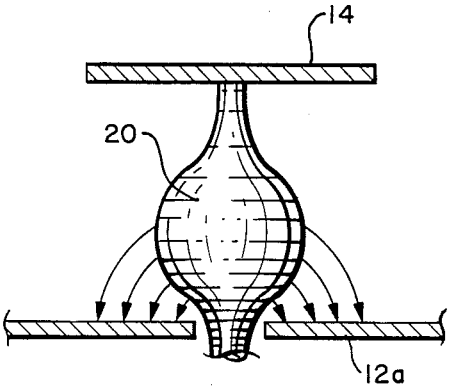
FIG. 4*b* shows the gradual change in the electric field introduced by the teardrop shape between a probe and a ground plane.

In feeding a microstrip antenna patch through a relatively thick substrate, a large inductance generally occurs around the feed probe due to its length. Normally, an impedance matching circuit can be provided for each feed probe to tune out the probe inductance, but that would introduce complexity and additional loss to the stripline feed circuit. Furthermore, there may not be enough space available in the stripline dielectric substrate 11 to accommodate the impedance matching circuits, so additional stripline circuit layers would be needed. To reduce this complexity, a teardrop shaped probe have been used, as shown in FIG. 4*a* for probes 20 and 20' to effectively tune out the probe inductance and provide 7.5% bandwidth for 1.5:1 VSWR impedance match. This impedance match results from the teardrop shape which introduces an appropriate amount of capacitance between it and the ground plane (sheet 12*a*) with a gradual change in the electric field as shown in FIG. 4*b* to cancel inherent inductance of the probe. The exact shape of the teardrop probe is not critical. What is important is its maximum diameter for the operating frequency. That diameter was experimentally determined to be 0.30 inch for the L-band requiring a half-inch honeycomb substrate 10.

A similar teardrop probe has been successfully scaled to 0.55 inch diameter for a UHF frequency at 850 MHz requiring a 1.0 inch thick honeycomb substrate. A teardrop probe for any frequency band may be readily scaled or empirically determined. In each case, the shape of the teardrop probe provides for a gradual change of the electric field around the probe used to couple through the thick substrate of the microstrip antenna array as shown in FIG. 4*a*. Looked at another way, the surface of the teardrop shape from its maximum diameter down and the metal sheet 12*a* provides the capacitance necessary to cancel the undesired inductance that is inherent in the probe.

Figure 6:
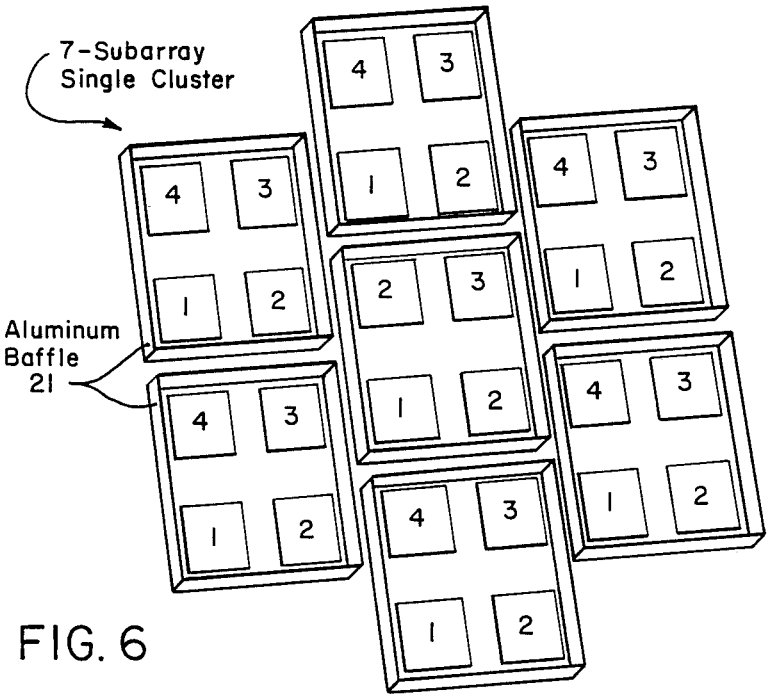
FIG. 6 illustrates a single cluster of seven subarrays with 28 patch elements on a honeycomb substrate and with a one-inch tall aluminum baffle around each subarray.

The fabricated array and stripline power dividers are as described and illustrated in FIGS. 4 and 5, respectively. The positions of teardrop feed probes for the four patch elements numbered 1, 2, 3 and 4 of each subarray are as indicated by dots in the rectangular patch elements shown in FIG. 1*b*. Since the microstrip substrate is relatively thick, as noted above, it generates relatively large surface waves which cause significant mutual coupling between subarrays. These surface waves and the consequent mutual coupling effect cause asymmetry in the field components and degrade the circular polarization performance. Introduction of aluminum baffles 21 around the subarrays, as shown in FIG. 6, can block out most of the surface waves and thus reduce the mutual coupling effect. It is found that one-inch tall baffles are required between all the subarrays to bring the on-axis axial ratio from 3 dB to less than 1 dB. Within each subarray, however, most of the unwanted field components caused by surface waves are cancelled and field symmetry is preserved due to the 0°, 90°, 180°, 270° angular orientation and field phase.

In the paper of John Huang, "A Technique for an Array to Generate Circular Polarization with Linearly Polarized Elements," cited above, the theoretical background and experimental verification was presented for obtaining a circularly polarized array from single-probe fed linearly polarized patch elements. To demonstrate the concept, a single cluster array composed of seven subarrays with 28 single-feed linearly polarized patches was constructed and tested, as shown in FIG. 6.

The overlapping cluster array concept can be demonstrated by two clusters of arrays as shown in FIG. 3. The two large circles represent the arrays to generate two contiguous beams, and each small circle is a subarray consisting of four microstrip patches. Each 7-subarray cluster has a total of 28 microstrip patches. The distance $d_f$ between the two adjacent 7-subarray clusters is essentially the same as the distance between adjacent 2×2 subarrays. The relatively sparse element spacing is a result of the overlapping cluster arrangement for optimum reflector illumination with a minimum number of elements in the array.

A single cluster array shown in FIG. 6 is provided with an amplitude taper so that the reflector is illuminated with the proper edge taper required for achieving low sidelobe levels. The outer six subarrays are powered equally and 13 dB below the center 2×2 subarray. As noted above, each of the seven 2×2 subarrays is fed by a stripline 4-way hybrid power divider so that 0°, 90°, 180°, 270° feeding point phases for the elements can be realized. In practice, a satellite stationed at a height of 22 miles may receive signals at one frequency and retransmit the signals at the same or other frequency. The satellite thus functions as a "relay tower" for communication between land mobile units using a large multiple-beam array antenna to receive and transmit.

Figure 7:
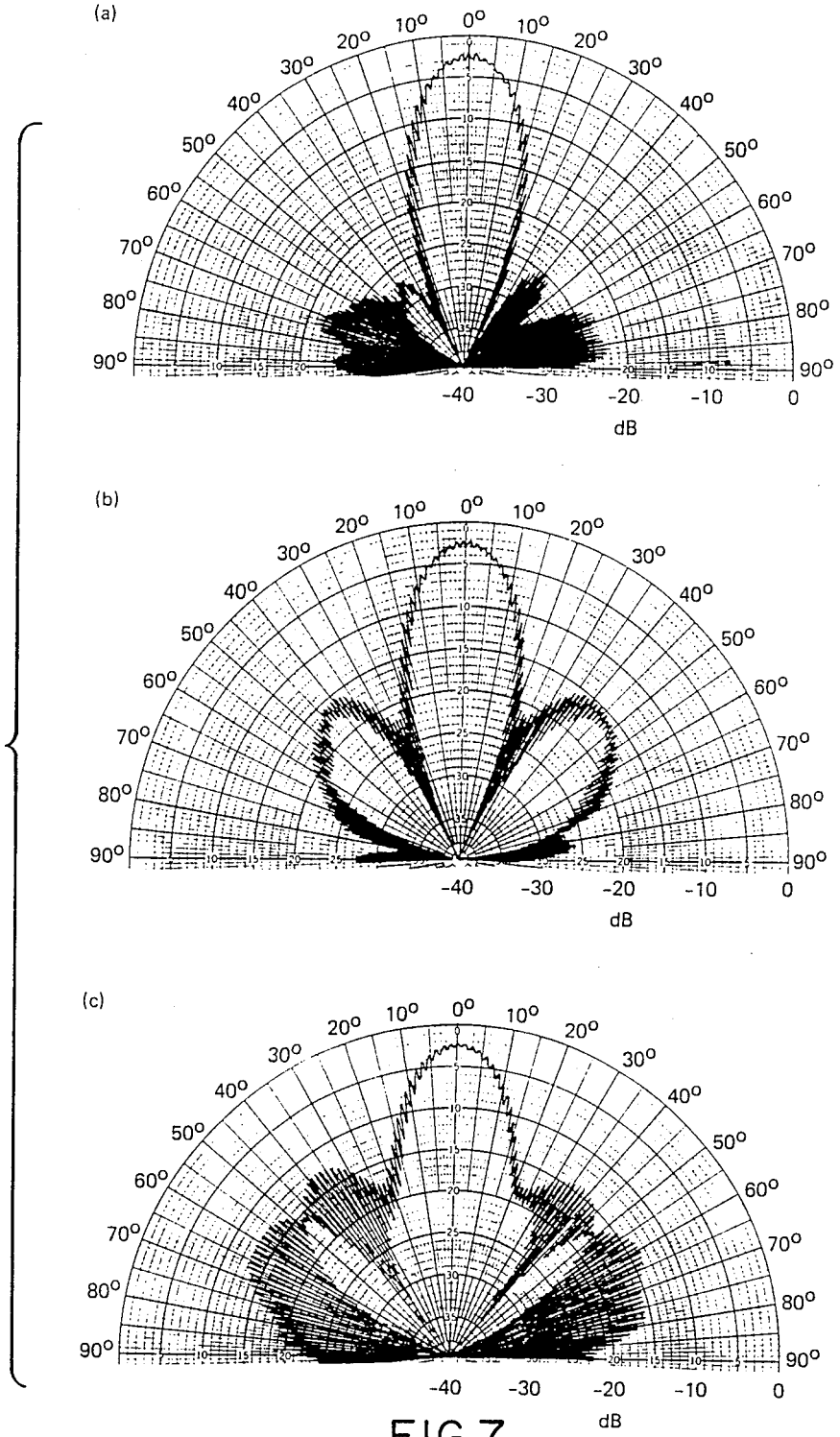
FIGS. 7*a, b* and *c* illustrate measured patterns at (a) $\phi=0°$ plane cut, (b) $\phi=45°$ plane cut and (c) $\phi=90°$ plane cut of the array shown in FIG. 6 by using a spinning linear dipole and feeding the array with 1.54 GHz signal.
Figure 8:
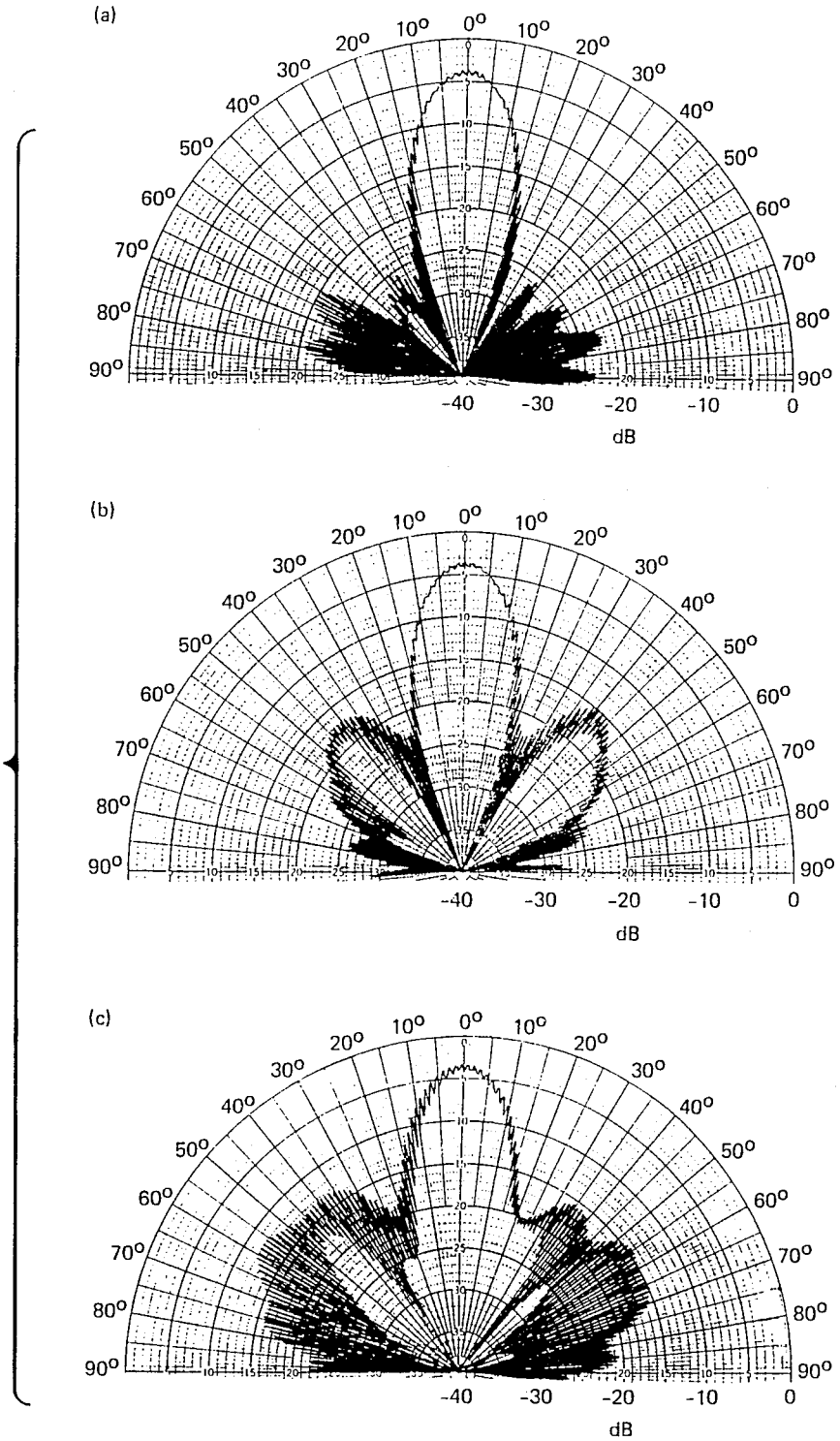
FIGS. 8*a, b* and c illustrate measured patterns at (a) $\phi=0°$ plane cut, (b) $\phi=45°$ plane cut and (c) $\phi=90°$ plane cut of the array shown in FIG. 6 by using a spinning linear dipole and feeding the array with 1.66 GHz signal.

The measured radiation patterns of the array shown in FIG. 6 are illustrated in FIGS. 7*a, b, c* and FIG. 8*a, b, c*. These are produced by a spinning-linear-dipole technique to graphically demonstrate the axial ratio performance of the array. FIGS. 7*a, b, c* are patterns measured at 1540 MHz for 0°, 45° and 90° plane cuts, respectively. FIGS. 8*a, b, c* are similar patterns measured at 1660 MHz. The axial ratio on the main beam peak is less than 0.8 dB for both frequencies.

Figure 9:
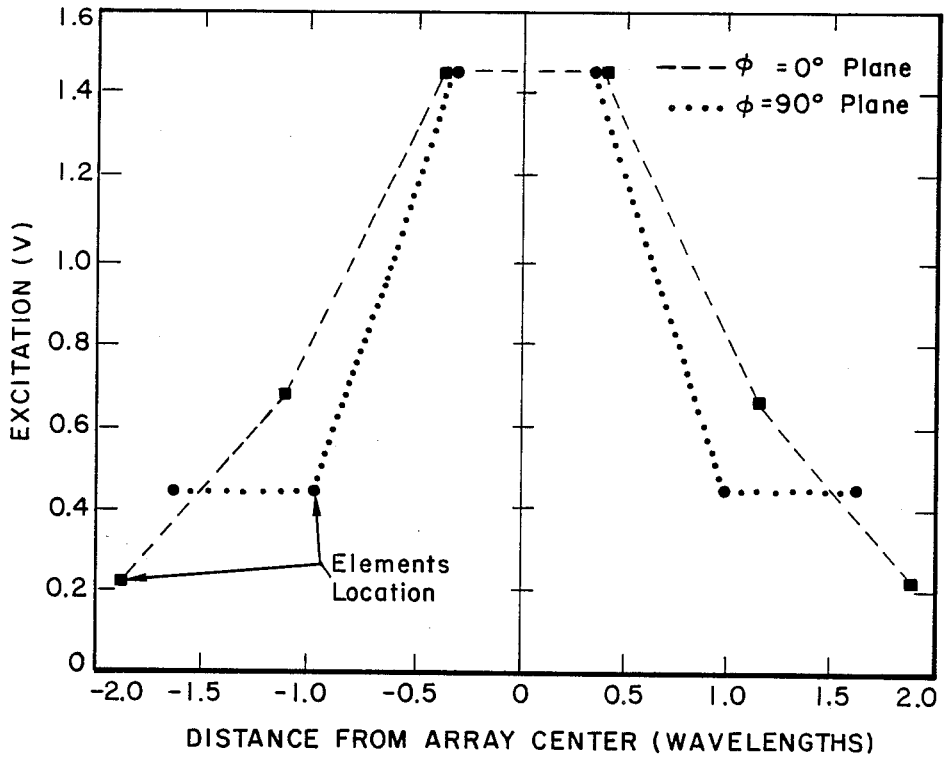
FIG. 9 illustrates in a graph the array amplitude taper for the 7-sub array cluster of FIG. 6.

The main beam of the array is rather symmetrical, and its 10 dB beamwidths for $\phi=0°$, 45° and 90° planes are nearly equal, as can be clearly seen in the experimental patterns of FIGS. 7*a, b, c* and FIGS. 8*a, b, c*. The rest of the pattern and the sidelobe levels, however, are quite different for various cuts. The design goal was to achieve circular symmetry for the main beam region of the array down to about 20 degrees from the center axis, which is about half the subtended angle from the focal point to the reflector. An edge taper of about 15 to 20 dB at this angle will produce better than 35 dB sidelobe levels (better than 30 after accounting for the reflector surface errors and other tolerances). Due to the inherent circular asymmetry of the 7-subarray feed, however, perfect symmetry for the feed pattern in all the cuts is hardly feasible. The effective amplitude taper in any plane of the array can be thought of as equivalent to the amplitude summation of all the orthogonal column elements. For example, the $\phi=0°$ plane effective amplitude distribution is 0.448, 1.344. 2.896, 2.896, 1.344, 0.448 which has three discrete steps, while the $\phi=90°$ plane amplitude distribution is 0.896, 0.896, 2.896, 2.896, 0.896, 0.896 which has only two discrete steps. This is graphically shown in FIG. 9.

The relatively high feed array sidelobe levels which result in a larger spillover past the reflector edge and hence lower reflector efficiency compared with a peak gain optimized reflector, are a consequence of the relatively large separation of the subarrays (1.5 and 1.3 wavelengths in 0° and 90° planes) imposed by the overlapping cluster requirement of the contiguous multibeam system. However, a complete three-dimensional pattern integration shows that the relatively high sidelobes encountered in the $\phi=45°$ and 90° planes will contribute to less than 0.3 dB of gain loss. The markedly higher sidelobe levels occurring in the $\phi=45°$ plane is primarily the result of the particular arrangement of the four linearly polarized elements.

A circularly polarized feed array for a satellite or spacecraft reflector antenna has been disclosed using linearly polarized microstrip elements. The array achieves better than 0.8 dB axial ratIo at the array pattern peak and better than 3 dB down to 20 degrees from the peak, across a 7.5% frequency bandwidth. A teardrop shaped feed probe is used to achieve wideband input impedance matching for the relatively thick microstrip substrate. A circularly polarized microstrip array thus provided can have simplified feed mechanism, reduced RF loss in the feed circuit and improved radiation performance over a wide frequency bandwidth. It is expected that 10% to 15% bandwidth can be achieved by using the same technique if the substrate thickness is further increased.

Although particular embodiments of the invention have been described and illustrated herein, it is recognized that modifications and variations may readily occur to those skilled in the art. Consequently, it is intended that the claims be interpreted to cover such modifications and variations.

I claim:

1. A circularly polarized microstrip array antenna comprised of a honeycomb substrate made of dielectric material, and a plurality of microstrip patch elements arranged in a cluster of seven subarrays, one subarray at the center and six subarrays spaced around said one subarray, each subarray being comprised of a square grid of four identical linearly polarized rectangular microstrip patch elements arranged on one side of said honeycomb substrate, each rectangular microstrip patch element having a feed point centered near one side, said one side of said four rectangular microstrip patch elements being oriented in a °, 90°, 180°, and 270° relationship taken in sequence around the grid in one direction to generate two orthogonally polarized fields while 0°, 90°, 180° and 270° feed phases are applied at the respective four feed points to provide phase delays for circular polarization of radiant energy from said grid, thereby providing said grid with a feed phase an angular orientation for jointly producing circularly polarized radiation, a groundplane on a side of aid planar honeycomb substatre opposite said microstrip patch elements, a circuit on a side of said ground plane opposite said honeycomb substrate for feeding said patch elements from a single feed point through said ground plane and said honeycomb substrate with feed phases at four separate point for circularly polarized radiation, and four probes for connecting said four patch elements to said four separate points in said circuit through said honeycomb substrate and ground plane, each probe being teardrop shaped to effectively tune out inductance of said probe by capacitance between the surface of said teardrop shaped probe and said ground plane.

2. A circularly polarized microstrip array antenna comprises of a planar honeycomb substrate made of dielectric material, a plurality of microstrip patch elements arranged on a surface of said honeycomb substrate in 2×2 subarrays, said microstrip patch elements of each subarray being arranged in a 0°, 90°, 180° and 270° relationship for both its element feed point near one side and its feed phases for jointly radiating circularly polarized energy, a stripline circuit on a surface of said honeycomb structure opposite said microstrip patch elements for feeding each of said microstrip patch elements from a single feed point at said 0°, 90°, 180° and 270° phases for circularly polarized radiation, said stripline circuit comprising a metal conductor pattern embedded in dielectric material between two sheets of metal, one sheet of metal between said honeycomb substrate and said dielectric material, and a second sheet of metal on the outside of said dielectric material functioning as a ground plane for said microstrip patch elements, and a plurality of probes for connecting said stripline circuit to said microstrip patch elements through apertures in said one sheet of metal, one probe for each microstrip patch element, each probe being teardrop shaped to effectively cancel undesired probe inductance by capacitance between the surface of said teardrop shaped probe and said second sheet of metal functioning as a ground plane.

3. In a large multiple beam satellite array antenna, a plurality of circularly polarized microstrip subarrays arranged on a honeycomb substrate in overlapping clusters of subarrays, each subarray being surrounded by six subarrays to form a seven-subarray cluster, an improvement in the construction of each subarray comprised of four linearly polarized microstrip patch elements arranged on one side of said substrate in a rectangular grid array with a feed phase and angular orientation for circular polarization of 0°, 90°, 180° and 270° for respective elements at four corners of said rectangular grid array taken in sequence around the grid in one direction, a stripline feed circuit embedded in dielectric material between two sheets of metal on a side of said honeycomb substrate opposite said rectangular grid array of microstrip patch elements for producing at four feed point associated with said patch elements energy at said feed phases of 0°, 90°, 180° and 270°, and four probes for connecting said four feed points with said four microstrip patch elements through said honeycomb substrate, each probe being teardrop shaped to introduce capacitance between the surface of the probe and the outer one of said metal sheet of said stripline circuit functioning as a ground plane for effectively cancelling inductance of said probe making a connection from said stripline circuit to a microstrip patch element through apertures in said inner one of said sheets of metal and said honeycomb substrate.

4. An improvement as defined in claim 3 wherein said stripline feed circuit includes a central feedpoint into said stripline feed circuit, a stripline power divider to divert equal energy into two branches, one of said two branches having a conductive path longer than the other sufficient to introduce 180° phase difference between said two branches, each of said two branches having at their end of stripline power divider for diverting equal energy into two conductive paths, one of said two conductive paths being sufficiently longer than the other to introduce a 90 ° phase difference between said two conductive paths.

5. A n improvement as define din claim 4 wherein each of said power dividers is comprised of a Wilkinson power divider.

6. An improvement as defined in claim 3 including a baffle separating each subarray from other subarrays, said baffle extending perpendicularly from said honeycomb substrate in the direction of radiation normal to said array of microstrip patch elements.

* * * * *